US007231946B2

(12) United States Patent
Ho et al.

(10) Patent No.: US 7,231,946 B2
(45) Date of Patent: Jun. 19, 2007

(54) PAINTBALL REFILLERS AND METHOD FOR MAKING AND USING SAME

(75) Inventors: Stephen Ho, Sugarland, TX (US); Kheng Pang, Sugarland, TX (US)

(73) Assignee: Avalon Advanced Products, Inc, Sugarland, TX (US)

( * ) Notice: Subject to any disclaimer, the term of this patent is extended or adjusted under 35 U.S.C. 154(b) by 104 days.

(21) Appl. No.: 10/420,528

(22) Filed: Apr. 22, 2003

(65) Prior Publication Data

US 2004/0211480 A1 Oct. 28, 2004

(51) Int. Cl.
*B65B 1/04* (2006.01)

(52) U.S. Cl. ..... 141/247; 141/18; 141/102; 141/315; 124/49

(58) Field of Classification Search ..... 141/2, 141/10, 18, 100–105, 247, 315, 391; 124/49, 124/50, 56, 73
See application file for complete search history.

(56) References Cited

U.S. PATENT DOCUMENTS

| | | | | |
|---|---|---|---|---|
| 3,494,538 | A * | 2/1970 | Matthews | 206/481 |
| 6,055,975 | A * | 5/2000 | Gallagher et al. | 124/50 |
| 2003/0154967 | A1 * | 8/2003 | Trier et al. | 124/49 |
| 2003/0200960 | A1 * | 10/2003 | Clark | 124/45 |
| 2004/0211685 | A1 * | 10/2004 | Brock | 206/315.1 |

* cited by examiner

*Primary Examiner*—Timothy L. Maust
(74) *Attorney, Agent, or Firm*—Robert W. Strozier

(57) ABSTRACT

A paintball hopper refill apparatus or loading apparatus is disclosed, which includes a body, an interior, a neck and a dispensing portion where the body is made of a flexible material, the interior is designed to be filled with a plurality of paintballs and the dispensing portion is designed to be opened either by pulling a pull string or by squeezing allowing the paintballs to flow from the loading apparatus to the hopper. A method for filling a hopper using the loading apparatus of this invention is also disclosed.

19 Claims, 7 Drawing Sheets

PAINTBALL REFILLERS AND METHOD FOR MAKING AND USING SAME

BACKGROUND OF THE INVENTION

1. Field of the Invention

The present invention relates to a paintball refiller apparatus and to method for using same.

More particularly, the present invention relates to a paintball refiner apparatus for paintball gun hoppers, where the refiner includes a bag having a pull member that when pulled opens a portion of the bag so that paintballs contained within the refiner fill up the interior of a paintball hopper. The present invention also relates to a method for filling paintball hopper.

2. Description of the Related Art

Numerous types of paintball hoppers have been designed and developed and represent the vehicle by which a large number paintballs are supplied individually to a paintball gun through its feed tube. The most difficult part of using such hoppers is refilling them in the field. Generally, paintballs are sold in large bags or contains in lots of 500 or more. Typical hoppers on the other hand hold only between about 50 and 300. Thus, filling is a very hands on and messing operations. One attempt to circumvent this problem is the lighting loader disclosed in U.S. Pat. No. 5,809,983 to Stoneking. The Stoneking loader is a plastic device that couples with a specially designed hopper to allow paintballs to flow from the loader into the hopper. However, this solution only works for special hoppers and requires the user to carry a supply of these bulky loader tubes.

Thus, there is a need in the art for a simple, compact loader that can be used to load any type of hoppers easily and quickly.

SUMMARY OF THE INVENTION

The present invention provides a loader apparatus including a bag having a filler and a dispenser, where the bag comprises a flexible material, is capable of holding a plurality of paintballs and the dispenser is capable of being opened when the apparatus is placed inside a hopper of a paintball gun. One major benefit of the apparatus is that it makes hopper refilling during a game quicker and easier.

The present invention also provides a loader apparatus a bag including a neck, a body having a dispensing portion and an opener, where the bag comprises a flexible material and is capable of holding a plurality of paintballs, and the opener opens the dispenser when the apparatus is placed inside a hopper of a paintball gun.

The present invention also provides a method for loading a paintball hopper including the steps of opening a lid of a hopper and feeding a paintball dispensing end of a loading apparatus of this invention into an interior of the hopper accessed via an opening of the hopper exposed when the lid is opened. Once the loading apparatus is in the interior of the hopper, the opener is activated opening the dispensing portion of the loading apparatus. Once all the paintballs have exited the loading apparatus via the dispensing portion, the loading apparatus is removed and the lid closed. The paintball hopper is now loaded and firing can commence.

The present invention also provides a method for loading a paintball hopper including the steps of also provides a method for loading a paintball hopper including the steps of opening a lid of a hopper having a locking assembly in the locked position and feeding a paintball dispensing end of a loading apparatus of this invention into an interior of the hopper accessed via an opening of the hopper exposed when the lid is opened. Once the loading apparatus is in the interior of the hopper, the opener is activated opening the dispensing portion of the loading apparatus. Once all the paintballs have exited the loading apparatus via the dispensing portion, the loading apparatus is removed and the lid closed. After the lid is closed, the locking assembly of the hopper is set to an unlocked position so that paintballs can flow into the gun and firing can commence.

DESCRIPTION OF THE DRAWINGS

The invention can be better understood with reference to the following detailed description together with the appended illustrative drawings in which like elements are numbered the same.

DETAILED DESCRIPTION OF THE INVENTION

The inventors have found that a paintball hopper loading apparatus can be constructed out of a flexible material with a dispensing portion, where the end of the apparatus having the dispensing portion is designed to be placed into the interior of the hopper and once inside the hopper, the dispensing portion is opened allowing a pre-determined number of paintballs contained in the loading apparatus to flow into the hopper. Because the loading apparatus is a light weight flexible material, it can be simply pocketed or discarded after paintball loading. Moreover, the flexible material allows the loading apparatus to be deformed for easy storage and so that the dispensing end can be easily fed into any type of opening in any type of hopper.

The present invention broadly relates to a hopper loading apparatus including body having an interior capable of receiving a pre-determined number of paintballs, a feeder adapted to receive the pre-determined number of paintballs, a dispensing portion adapted to be placed inside an interior of a paintball hopper and adapted to open allow the pre-determined number of paintballs to fill the interior of the hopper quickly and easily even during a paintball game or exercise.

The present invention also broadly relates to a method for loading a paintball hopper including the steps of: placing a dispensing portion of a loading apparatus of this invention inside an interior of a paintball hopper. Once the dispensing portion of the loading apparatus is inside the hopper, the dispensing portion is opened and the paintballs are transferred from or allowed to flow out of the loading apparatus and into the hopper, filling the hopper. Once filled, a gun to which the hopper is connected is ready to use without having to disconnect the hopper or replace the hopper with a filled hopper.

The hopper loading apparatus can be constructed out of any flexible material including, without limitation, a plastic material (solid or open woven), a cloth material, a mesh or netting material, or any other flexible material or mixture or combinations thereof. Preferred flexible materials include, without limitation, polyolefin films, natural or synthetic cloth, and plastic or natural mesh material or mixture or combinations thereof. Exemplary examples include polyethylene films, polypropylene films, nylon films, polyester films, cotton cloth, canvas cloth, polyester cloth, nylon cloth, a Kevlar® cloth, or the like or mixture or combinations thereof.

Hopper Loading Apparatus

Figures 1A, 1B, 1C:
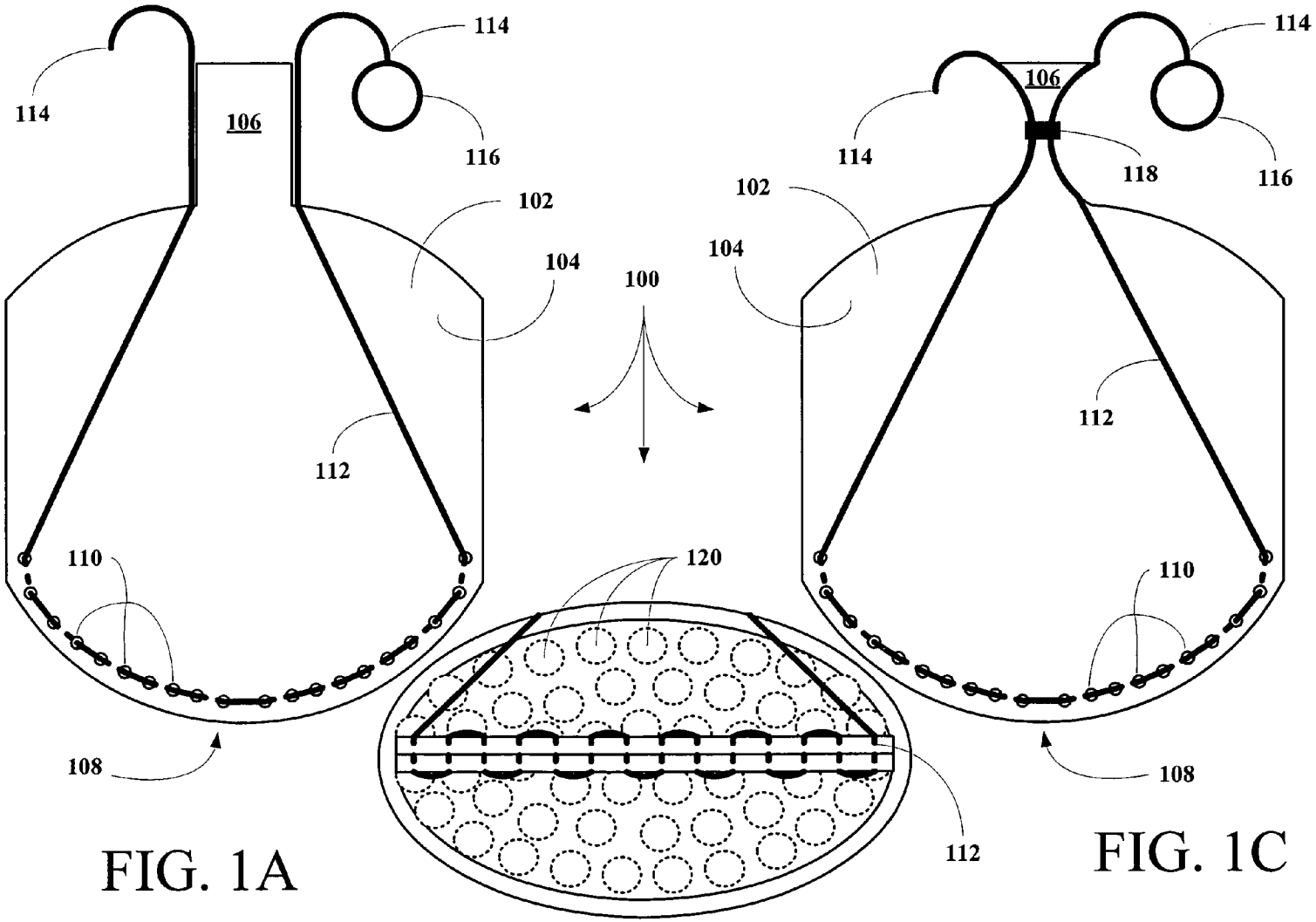
FIGS. 1A–C depict a preferred embodiment of a hopper loading apparatus of this invention.

Referring now to FIGS. 1A–C, a preferred embodiment of a hopper loading apparatus of this invention, generally 100, is shown to include a body 102 having an interior 104 adapted to hold a plurality of paintballs 120 as shown in FIG. 1B, a feeding neck 106 and a dispensing portion 108 located opposite the neck 106. The dispensing portion 108 includes a plurality of apertures 110 having a pull string 112 threaded therethrough as shown in an expanded end view in FIG. 1B, where the dispensing portion 108 is opened and sown shut by the string 112. The apparatus 100 is shown as a squat cylinder shape having rounded or dome shaped ends and to comprise a material having a thickness sufficient to hold the paintballs 120. Both ends 114 of the pull string 112 extend out past the neck 106. Preferably, one end 114 of the pull string 112 includes a pull ring 116 affixed thereto. After the apparatus 100 is filled with a pre-determined number of paintballs, the neck 106 is crimped with a crimping member 118 so that the ends 114 extend out past the crimping member 118. The crimping member 118 is shown here as a band, but can be a twist tie, a zip tie, a velcro® tie or any other type of crimping member. The only criterion that the crimping member 118 needs to possess is that ability to hold the pull string 112 in place, but not so tight as to unduly restrict its movement so that the string 112 can be pulled free of the apparatus 100 opening the dispensing portion 108 and allowing the paintballs 120 to exit the apparatus 100 filing a hopper. The pull ring 116 is provided to aid the user in pulling the pull string 112 out of the apparatus 100 to dispense the paintballs.

Figures 2A, 2B, 2C:
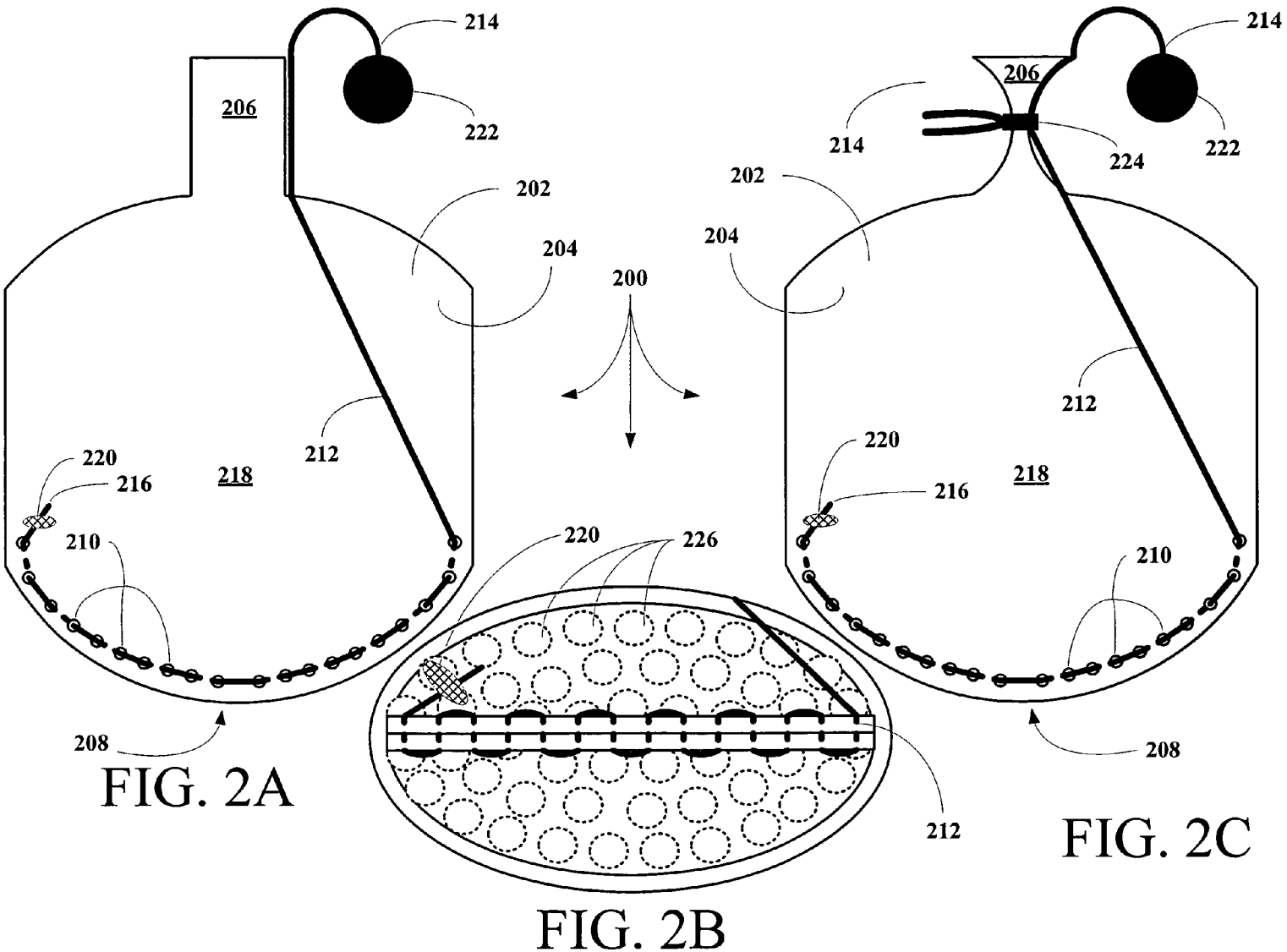
FIGS. 2A–C depict another preferred embodiment of a hopper loading apparatus of this invention.

Referring now to FIGS. 2A–C, another preferred embodiment of a hopper loading apparatus of this invention, generally 200, is shown to include a body 202 having an interior 204 adapted to hold a plurality of paintballs 226 as shown in FIG. 2B, a feeding neck 206 and a dispensing portion 208 located opposite the neck 206. The dispensing portion 208 includes a plurality of apertures 210 having a pull string 212 threaded therethrough as shown in an expanded end view in FIG. 2B, where the dispensing portion 208 is opened and sown shut by the string 212. The apparatus 200 is shown as a squat cylinder shape having rounded or dome shaped ends and to comprise a material having a thickness sufficient to hold the paintballs 226. One end 214 of the pull string 212 extend out past the neck 206, while the other end 216 is loosely attached to an outer surface 218 of the apparatus 200 by an attachment member 220. Preferably, the end 214 of the pull string 212 includes a pull tab 222 affixed thereto. The attachment member 220 can be an adhesive patch or a low surface tension patch where the adhesive or cohesive interaction with the surface 218 of the apparatus 200 is sufficiently weak to allow the string 212 to be pulled free of the member 220.

After the apparatus 200 is filled with a pre-determined number of paintballs 226, the neck 206 is crimped with a crimping member 224 so that the end 214 extend out past the crimping member 224. The crimping member 224 is shown here as a twist tie, but can be a band, a zip tie, a velcro® tie or any other type of crimping member. The only criterion that the crimping member 224 needs to possess is that ability to hold the pull string 212 in place, but not so tight as to unduly restrict its movement so that the string 212 can be pulled free of the apparatus 200 opening the dispensing portion 208 and allowing the paintballs 226 to exit the apparatus 200 filing a hopper.

Figures 3A, 3B, 3C:
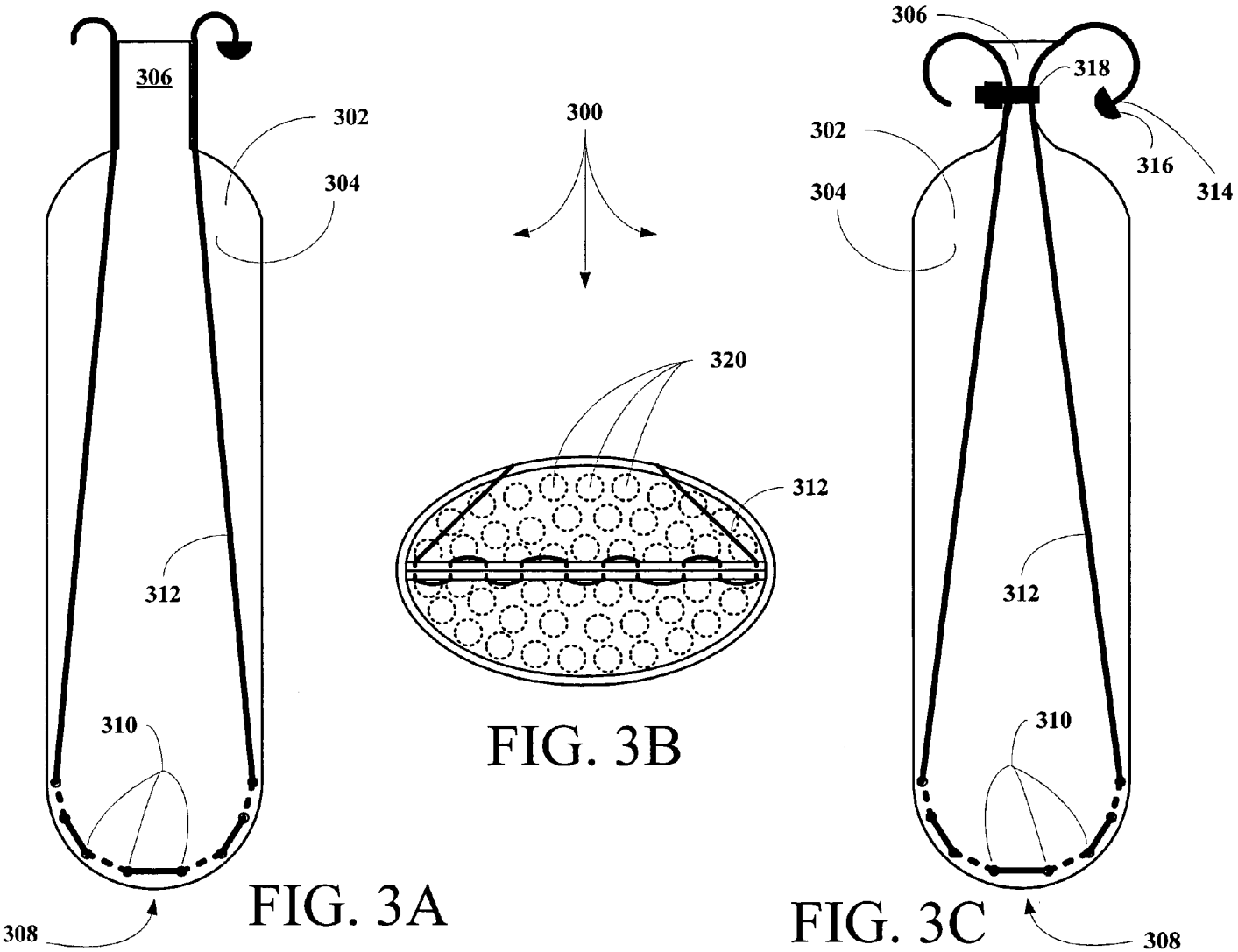
FIGS. 3A–C depict another preferred embodiment of a hopper loading apparatus of this invention.

Referring now to FIGS. 3A&B, another preferred embodiment of a hopper loading apparatus of this invention, generally 300, is shown to include a body 302 having an interior 304 adapted to hold a plurality of paintballs 320 as shown in FIG. 3B, a feeding neck 306 and a dispensing portion 308 located opposite the neck 306. The dispensing portion 308 includes a plurality of apertures 310 having a pull string 312 threaded therethrough as shown in an expanded end view in FIG. 3B. Both ends 314 of the pull string 312 extend out past the neck 306. Preferably, one end 314 of the pull string 312 includes a pull tab 316 affixed thereto. The apparatus 300 is shown as an elongated cylinder shape having rounded or dome shaped ends and to comprise a material having a thickness sufficient to hold the paintballs 320. After the apparatus 300 is filled with a pre-determined number of paintballs 320, the neck 306 is crimped with a crimping member 318 so that the ends 314 extend out past the crimping member 318. The crimping member 318 is shown here as a zip tie, but can be a twist tie, a band, a velcro® tie or any other type of crimping member. The only criterion that the crimping member 318 needs to possess is that ability to hold the pull string 312 in place, but not so tight as to unduly restrict its movement so that the string 312 can be pulled free of the apparatus 300 opening the dispensing portion 308 and allowing the paintballs to exit the apparatus 300 filing a hopper.

Figures 4A, 4B:
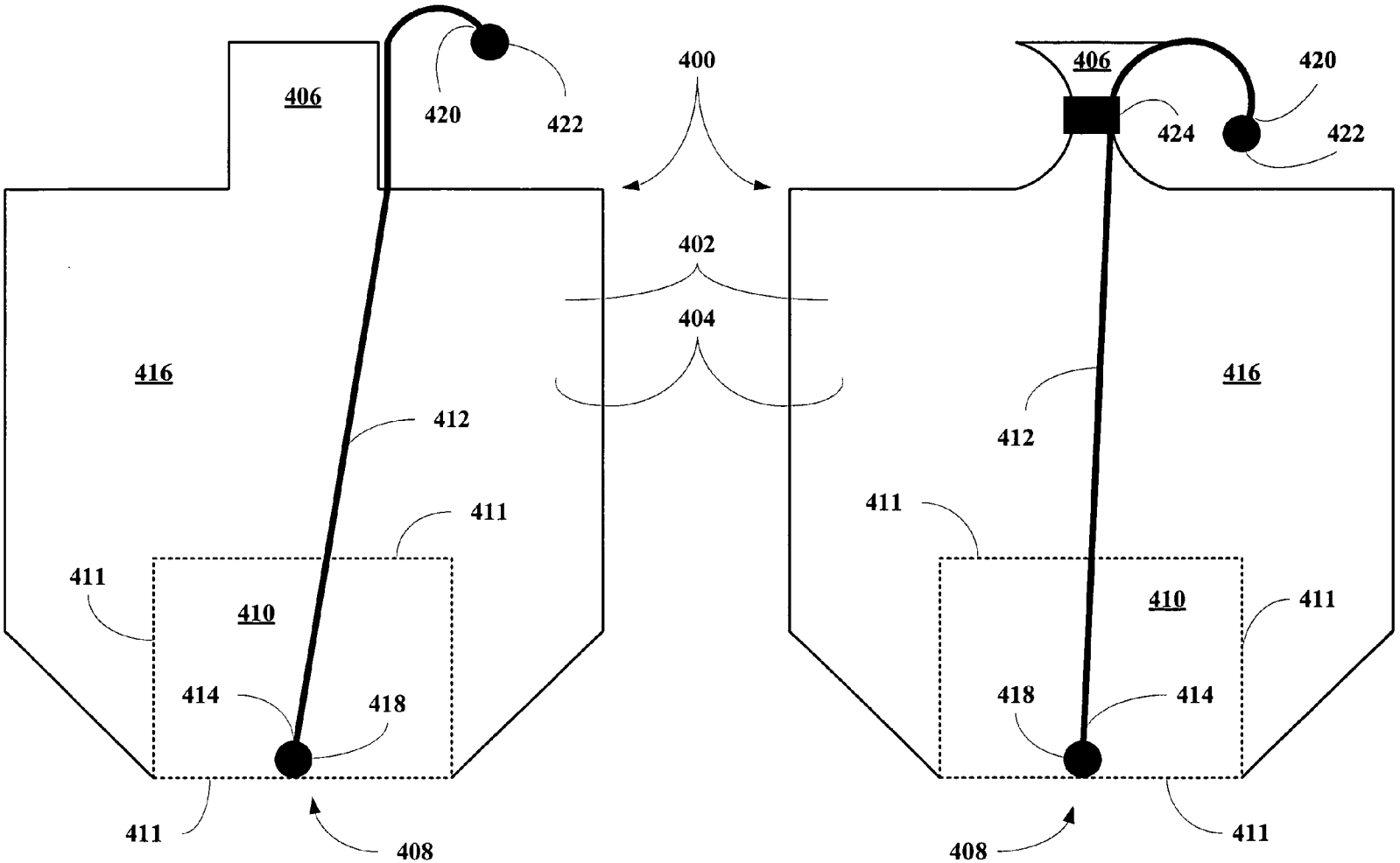
FIGS. 4A–B depict another preferred embodiment of a hopper loading apparatus of this invention.

Referring now to FIGS. 4A–C, another preferred embodiment of a hopper loading apparatus of this invention, generally 400, is shown to include a body 402 having an interior 404 adapted to hold a plurality of paintballs (not shown), a feeding neck 406 and a dispensing portion 408 located opposite the neck 406. The dispensing portion 408 includes a perforated flap 410 having perforated lines 411 a pull string 412 attached at a first end 414 to an outer surface 416 of the apparatus 400 by an attachment member 418. The perforated lines 411 are designed to allow the flap 410 to be torn away from the body 402 forming an opening through which the paintballs can exit the interior 404 of the apparatus 400. The attachment member 418 is generally an adhesive dot used to fix the end 414 to the outer surface 416 of the body 402. A second end 420 of the pull string 412 extend out past the neck 406. Preferably, the end 420 of the pull string 412 includes a pull tab 422 affixed thereto. After the apparatus 400 is filled with a predetermined number of paintballs (not shown), the neck 406 is crimped with a crimping member 424 so that the ends 414 extend out past the crimping member 424. The crimping member 424 is shown here as a velcro® tie, but can be a twist tie, a band, a zip tie, or any other type of crimping member. The only criterion that the crimping member 424 needs to possess is that ability to hold the pull string 412 in place, but not so tight as to unduly restrict its movement so that the string 412 can be pulled free of the apparatus 400 opening the dispensing portion 408 and allowing the paintballs to exit the apparatus 400 filing a hopper. The apparatus 400 is ship shaped and is composed of a material having sufficient thickness and strength to hold the paintballs.

Figures 5A, 5B, 5C:
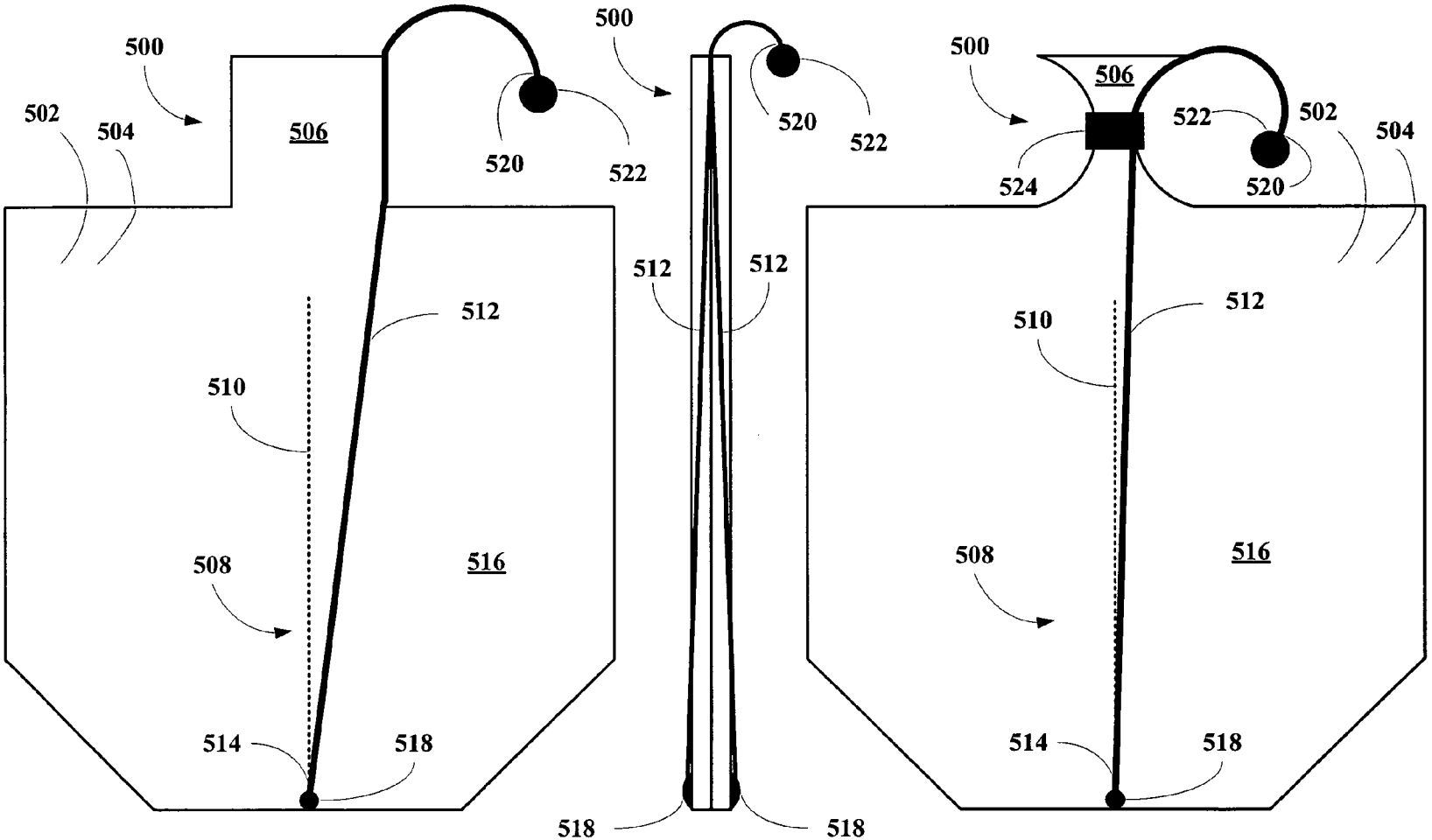
FIGS. 5A–C depict another preferred embodiment of a hopper loading apparatus of this invention.

Referring now to FIGS. 5A–C, another preferred embodiment of a hopper loading apparatus of this invention, generally 500, is shown to include a body 502 having an interior 504 adapted to hold a plurality of paintballs (not shown), a feeding neck 506 and a dispensing portion 508 located opposite the neck 506. The dispensing portion 508 includes a vertical perforated line 510 having pull strings 512 attached at first ends 514 to an outer surface 516 of the apparatus 500 by attachment members 518 as shown in an expanded end view in FIG. 5B. The perforated line 510 is designed to allow the body 502 to be torn open along the line 510 away forming an opening through which the paintballs can exit the interior 504 of the apparatus 500. The attachment members 518 are generally an adhesive dot used to fix the ends 514 to the outer surface 516 of the body 502. Second ends 520 of the pull string 512 extend out past the neck 506. Preferably, the ends 520 of the pull strings 512 are affixed to a pull tab 522. After the apparatus 500 is filled with a pre-determined number of paintballs (not shown), the neck 506 is crimped with a crimping member 524 so that the ends 514 extend out past the crimping member 524. The crimping member 524 is shown here as a band, but can be a twist tie, a zip tie, or any other type of crimping member. The only criterion that the crimping member 524 needs to possess is that ability to hold the pull strings 512 in place, but not so tight as to unduly restrict its movement so that the strings 512 can be pulled free of the apparatus 500 opening the dispensing portion 508 and allowing the paintballs to exit the apparatus 500 filing a hopper. The apparatus 500 is ship shaped and is composed of a material having sufficient thickness and strength to hold the paintballs.

Figures 6A, 6B, 6C:
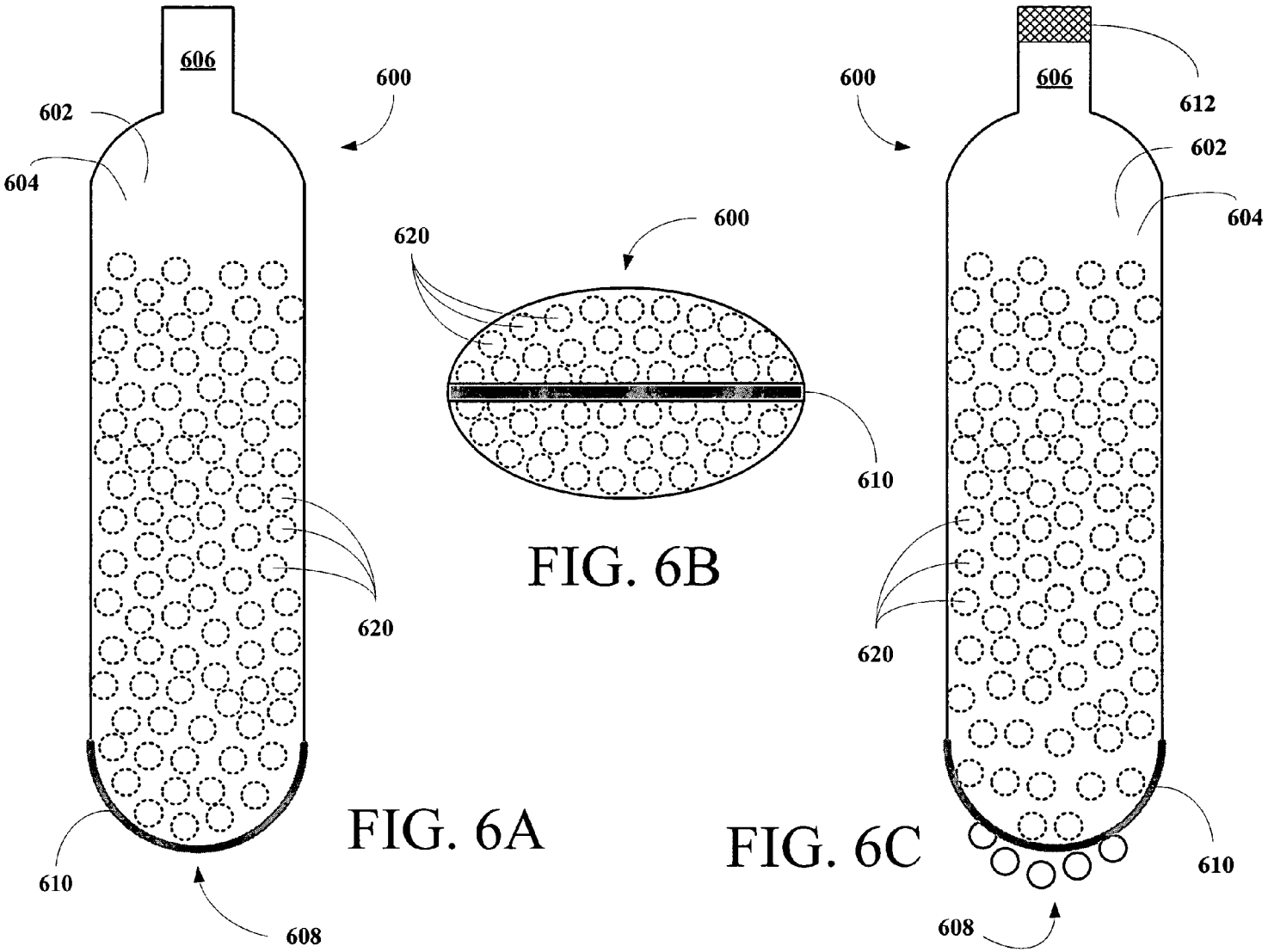
FIGS. 6A–C depict another preferred embodiment of a hopper loading apparatus of this invention.

Referring now to FIGS. 6A–C, another preferred embodiment of a hopper loading apparatus of this invention, generally 600, is shown to include a body 602 having an interior 604 adapted to hold a plurality of paintballs 620, a feeding neck 606 and a dispensing portion 608 located opposite the neck 606. The dispensing portion 608 comprises a weakened air tight seam 610. After the apparatus 600 is filled with a pre-determined number of paintballs 620, the neck 606 is sealed in an air tight manner by seal 612 so that the interior 604 includes a volume of gas 614 above and surrounding the paintballs 620. Once the dispensing portion 608 is placed in the interior of a hopper, the apparatus is simply squeezed at its neck end 614 with sufficient pressure to rupture the seam 610 forming an opening through which the paintballs 620 can exit the apparatus 600 filling the hopper.

The hopper loading apparatuses of this invention can be of any shape and/or any size. However, generally, the hopper loading apparatuses of this invention are sized to hold between about 50 and about 300 paintballs depending on the size of the hopper to be filled. Preferably, the hopper loading apparatus of this invention are sized to hold between about 100 and about 300 paintballs with sizes for 100, 150, 200, 250, and 300 paintballs being particularly preferred. Moreover, the necks of the apparatuses can be reinforced to aid apparatus filling. The apparatuses are designed to be manually and preferably automatically filled. Preferably, the apparatuses are held in an filling machine at the paintball manufacturers facility, where a pre-determined number of paintballs are loaded into the loading apparatus. After filling the apparatus with paintballs, the crimping member is attached to the loading apparatus, and the loading apparatuses are ready for shipment to vendors. One main advantage of the apparatuses of this invention is that the paintballs do not ever come in contact with humans and minimally contact the environment limiting damage to the paintballs through contact.

Method of Loading a Paintball Hopper

Figures 7A, 7B, 7C:
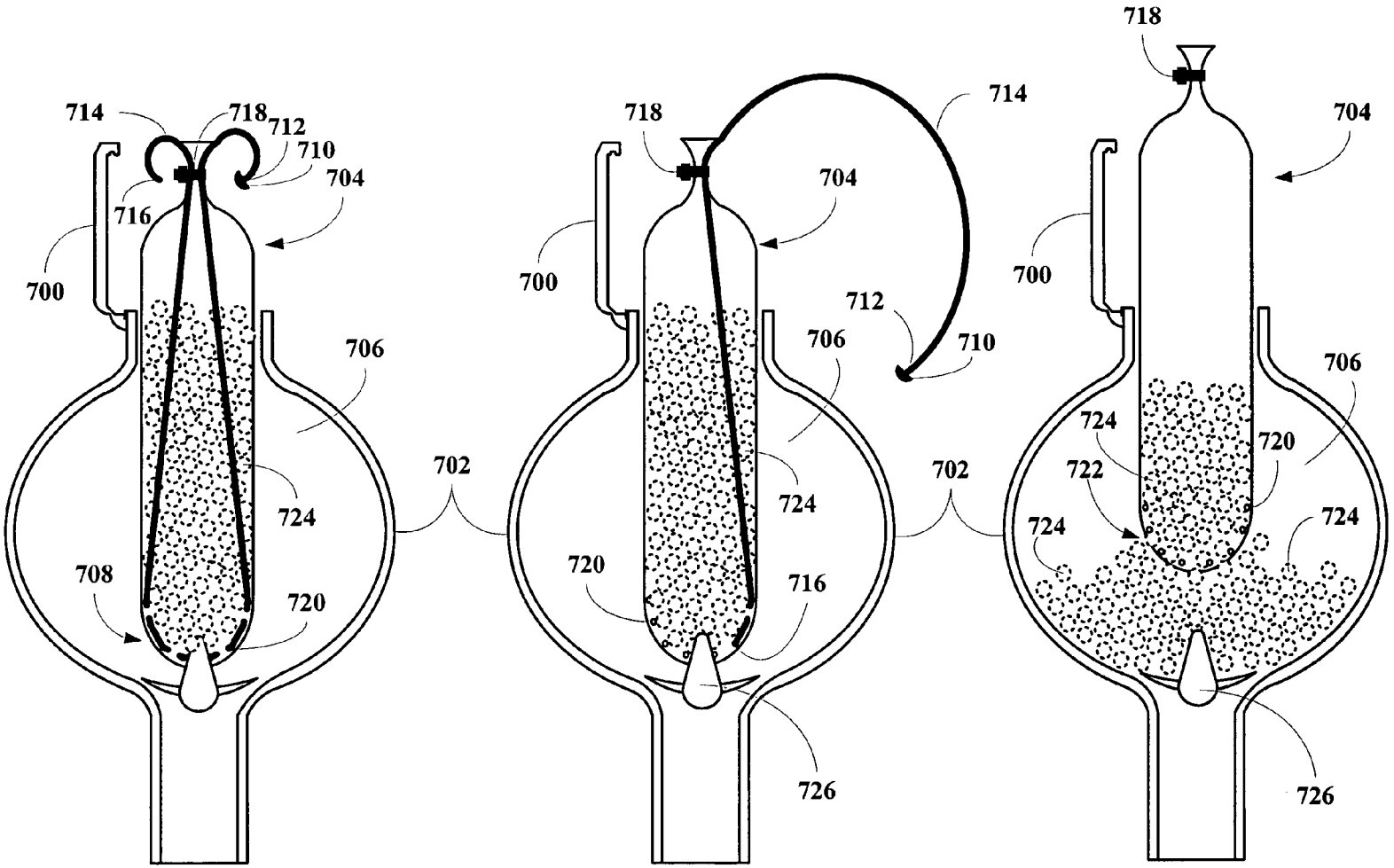
FIGS. 7A–C depict a method for loading a hopper with a hopper loading apparatus of this invention.

Referring now to FIGS. 7A–C, a preferred method for filling a paintball hopper is illustrated. A lid 700 of a hopper 702 is opened and a loading apparatus 704 of this invention is inserted into an opening 706 of the hopper 702 so that a dispensing portion 708 of the loading apparatus 704 is within an interior 706 of the hopper 702 as shown in FIG. 7A. Once the dispensing portion 708 of the apparatus 704 is positioned in the interior 706 of the hopper 702, the user pulls on a tab 710 (half moon shaped here) affixed to a first end 712 of a pull string 714 pulling a second string end 716 through a zip tie crimping member 718 and through threading apertures 720. Continuing the pulling operation, unzips the dispensing portion 708 forming an opening 722 through which a pre-determined number of paintballs 724 fill the interior 706 of the hopper 702 shown here with a locking assembly 726. After the paintballs 724 have been transferred from the loader 704 to the hopper 702, the loader 704 can be discharged and the lid 700 shut. If the hopper 702 is attached to a paintball gun, then the locking assembly 726 can be either in the open or closed position, while if the hopper 702 is not attached to a paintball gun, then the locking assembly 726 should be in the locked position. However, for locking type hoppers, loading should preferably occur with the locking assembly in the closed position. For non-locking hoppers, loading should occur only when the hopper is attached to a paintball gun to minimize paintball loss.

All references cited herein are incorporated herein by reference. While this invention has been described fully and completely, it should be understood that, within the scope of the appended claims, the invention may be practiced otherwise than as specifically described. Although the invention has been disclosed with reference to its preferred embodiments, from reading this description those of skill in the art may appreciate changes and modification that may be made which do not depart from the scope and spirit of the invention as described above and claimed hereafter.

We claim:

1. A paintball hopper loader comprising a body having an interior filled with a plurality of paintballs, a closed feeder end through which loader was filled with the pre-determined number of paintballs, a dispensing portion comprising an opened section including a plurality of apertures, where the dispensing portion is adapted to be inserted into an interior of a paintball hopper and an opener comprising a pull string threaded through the apertures to hold the opened section closed having ends and attached to the closed feeder end, where the opener is adapted to open the dispensing portion after the dispensing portion has been inserted into the interior of the hopper.

2. The loader of claim 1, wherein the body comprises a flexible material.

3. The loader of claim 1, wherein the plurality of paintballs is a pre-determined number of paintballs between about 50 and about 300.

4. The loader of claim 3, wherein the pre-determined number of paintballs is 100, 150, 200, 250 or 300.

5. The loader of claim 2, wherein the flexible material is selected from the group consisting of a film, a cloth, a mesh and a combination thereof.

6. A paintball hopper loading apparatus comprising an opener and a bag including a dispensing portion comprising an opened section including a plurality of apertures and an interior having a plurality of paintballs, where the opener comprises a pull string threaded through the apertures and having a first end and a second end so that when one end of the string is pulled, the string is pulled out of the apertures opening the dispensing portion, where the dispensing portion is adapted to be inserted inside a paintball hopper and opened allowing the paintballs to be transferred from the interior of the bag to an interior of the hopper.

7. The apparatus of claim 6, wherein the bag comprises a flexible material.

8. The apparatus of claim 7, wherein the flexible material is selected from the group consisting of a film, a cloth, a mesh and a combination thereof.

9. The apparatus of claim 6, wherein the bag further including a neck and a crimping member adapted to crimp the neck of the apparatus, where the neck includes an aperture through which the bag is filled with the paintballs.

10. The apparatus of claim 9, wherein the first end and the second end of the string extend out past the crimping member.

11. The apparatus of claim 10, wherein the first end includes a pull tab.

12. The apparatus of claim 10, wherein the bag comprises an elongate tubular shape with the dispensing portion located opposite the neck.

13. The apparatus of claim 6, wherein the second end of the string is detachably attached to an exterior surface of the bag.

14. The apparatus of claim 13, wherein the first end includes a pull tab.

15. The apparatus of claim 13, wherein the bag comprises an elongate tubular shape with the dispensing portion located opposite the neck.

16. The apparatus of claim 6, wherein the bag further including a neck through which the bag is filled with paintballs and an air tight seal adapted to seal the bag.

17. The apparatus of claim 6, wherein the plurality of paintballs is a pre-determined number of paintballs.

18. The apparatus of claim 17, wherein the pre-determined number of paintballs is between about 50 and about 300.

19. The apparatus of claim 17, wherein the pre-determined number of paintballs is 100, 150, 200, 250 or 300.

* * * * *